United States Patent [19]

Bond

[11] Patent Number: 4,610,925

[45] Date of Patent: Sep. 9, 1986

[54] ANTISTATIC HAIRBRUSH FILAMENT

[75] Inventor: William B. Bond, Marietta, Ohio

[73] Assignee: E. I. Du Pont de Nemours and Company, Wilmington, Del.

[21] Appl. No.: 607,210

[22] Filed: May 4, 1984

[51] Int. Cl.[4] ..... D01F 8/04

[52] U.S. Cl. ..... 428/368; 428/373; 428/395

[58] Field of Search ..... 428/364, 373, 372, 368, 428/374, 910, 475.2, 475.8, 476.1, 474.4, 395; 264/171; 15/159 A

[56] References Cited

U.S. PATENT DOCUMENTS

| | | | |
|---|---|---|---|
| 3,175,339 | 3/1965 | McDowell | 55/74 |
| 4,207,376 | 6/1980 | Nagayasu et al. | 428/367 |
| 4,388,370 | 6/1983 | Ellis et al. | 428/373 |
| 4,420,534 | 12/1983 | Matsui et al. | 428/372 |

FOREIGN PATENT DOCUMENTS

| | | | |
|---|---|---|---|
| 5147200 | 5/1982 | Japan . | |
| 1417394 | 12/1975 | United Kingdom . | |
| 2077182 | 12/1981 | United Kingdom | 264/171 |

*Primary Examiner*—Marion C. McCamish
*Attorney, Agent, or Firm*—Donald W. Huntley

[57] ABSTRACT

Antistatic hairbrush bristle having a nylon or polyester core and a compatible polymeric sheath containing carbon.

6 Claims, No Drawings

ANTISTATIC HAIRBRUSH FILAMENT

BACKGROUND OF THE INVENTION

A wide variety of synthetic materials has been proposed for use as a substitute for hog bristles in brush applications, such as toothbrushes and hairbrushes. Nylon and polyester monofilaments have been used in both of these end uses. However, a continued difficulty, particularly with hairbrushes, is the creation of static electric charges with the use of polymeric brush bristles, especially at relative humidities below about 50% that are typical of dry climates and the colder winter months in many areas. While several antistatic brushes have been suggested in the past, none has provided the balance of tensile properties and antistatic characteristics that is needed for outstanding brush bristle performance.

SUMMARY OF THE INVENTION

The instant invention provides an improved monofilament suitable for use as a hairbrush bristle which provides an outstanding combination of antistatic performance and the tensile properties needed for a hairbrush bristle.

Specifically, the instant invention provides an oriented sheath-core monofilament suitable for use as a hairbrush bristle having a diameter of at least about 0.25 mm and (A) a core of polymer selected from the group consisting of nylon and polyester in which the polyester is at least about 60 weight percent polybutylene terephthalate and the balance of the polyester selected from polyethylene terephthalate and cyclohexane dimethanol terephthalate, and (B) a sheath adhered to the core, comprising about 10–40 weight percent of the monofilament and prepared from polymers selected from the group consisting of nylon 11, nylon 12, nylon 610, nylon 612 and copolyetherester, the sheath polymer having a melting point no greater than that of the core, and the sheath containing about from 20 to 30 weight percent carbon, uniformly admixed with the sheath polymer. the monofilament having a resistance of less than about 4 megaohms per cm and a Tensile Coefficient as defined herein of about from 0.3 to 5.0.

Preferably, the carbon used in the monofilament has a particle size of less than about 20 microns.

DETAILED DESCRIPTION OF THE INVENTION

A wide variety of nylons and polyesters can be used for the core of the present monofilaments Nylons which can be used for the core include polyhexamethylene adipamide (nylon 66) polycaprolactam (nylon 6) polyundecanoamide (nylon 11), poly dodecanoamide (nylon 12), polyhexamethylenedecanoamide (nylon 610), and polyhexamethylene dodecanoamide (nylon 612). In addition, polyesters can be used for the core, provided that at least about 50 weight percent of the polyester is polybutylene terephthalate (4GT), and the balance of the polyester is selected from polyethylene terephthalate and cyclohexane dimethanol terephthalate.

The polymer used for the sheath component of the present monofilaments must be adhered to the core and should have a melting point no greater than that of the core. For satisfactory adhesion, the melt viscosity of the core and sheath polymers should be substantially the same. Accordingly, the sheath polymer should be of the same polymeric type as that of the core polymer. For example, a nylon sheath on a polyester core will lack the required sheath-core adhesion. Nylon which can be used for the sheath material can be selected from the group consisting of nylon 11, nylon 12, nylon 610, and nylon 612. Polyesters which can be used for the sheath material include polyetheresters. In general, copolyetherester elastomers should be used for the sheath material having 40–70 weight percent short chain polyether ester units and 10–30 weight percent phthalate or isophthalate moieties, with the balance being terephthalate. Copolyetheresters which can be used in the present invention include those copolymers which, together with their preparation, are described in Shivers, U.S. Pat. No. 3,023,192; Wisiepe, U.S. Pat. No. 3,651,014; Witsiepe, U.S. Pat. No. 3,766,146 and Hoh et al., U.S. Pat. No. 3,932,326, the disclosures of all of which are hereby incorporated by reference. Such copolyetheresters are commercially available as Hytrel® polyester elastomer resins.

The carbon black incorporated into the sheath of the present monofilaments can be selected from most commercially available carbon blacks. Preferably, the carbon black has a particle size of less than 20 microns and a surface area greater than 30 square meters per gram. The surface area is determined by nitrogen absorption as described in ASTM-D-3037-81, hereby incorporated by reference. In addition, the carbon blacks typically exhibit a dibutylphthalate absorption value of more than 50 cubic centimeters per 100 grams. Specific carbon blacks which can be used include, for example, acetylene blacks, intermediate super abrasion furnace blacks, conductive furnace blacks, conducting channel blacks and fine thermal blacks.

The sheath-core monofilaments for the present invention can be prepared by conventional coextrusion techniques, as described, for example, in Kilian U.S. Pat. No. 2,936,482, hereby incorporated by reference. For uniform admixture of the polymer and carbon black components of the sheath, it is desirable to separately feed the polymer and carbon streams to the coextrusion apparatus. The polymer and carbon black typically exhibit different flow rates, and the separate feeds permit more precise control over the relative proportions. In the alternative, polymer for the sheath component can be introduced into the extruder first, and the carbon black added at a downstream point of the coextrusion apparatus after the sheath polymer is in a molten condition.

The sheath component comprises about 10–40 weight percent of the monofilament. Less than about 10% of the sheath component can result in disruption of the conductive path during spinning and orientation of the filament, while more than about 40% can result in a reduction in the strength and toughness of the final product.

Preferably, for uniformity of the sheath component of the present monofilaments, the sheath polymer and carbon black are compounded in a separate, preliminary step, independent of the final coextrusion apparatus. Blending can be accomplished in conventional blending equipment, for example, a Banbury blender, a Farrell continuous mixer or a twin screw mixer. Generally, the carbon black and the polymer are added at the same time. If added separately, the sheath polymer is introduced into the blending apparatus first, and the carbon black added once the polymer is molten. With screw mixers, a good dispersion of the carbon black in the polymer can be obtained even when starting with a dry blend of the two components, if they are of roughly the same particle size. In addition to the above techniques for preblending the sheath polymer and carbon black, prepared blends of polymer and carbon can be used, such as HTR-4659 and Hytrel G-40CB, both commercially available from E. I. du Pont de Nemours and Company.

Carbon blacks which have been found to be particularly satisfactory in the present invention include Vulcan P, Vulcan 9 and Black Pearls, carbon blacks commercially available from Cabot Corporation and Ketjenblack EC commercially available from Noury Chemical Corporation, a division of Akzona Incorporated.

When commercial blends of carbon black and polymer are used for the sheath component of the present monofilments, concentrated carbon black dispersions can be let down with additional quantities of the same or different polymer used in the carbon black dispersion.

The concentration of carbon black in the sheath components of the present monofilaments is about 20 to 30 weight percent. Less than about 20 weight percent of the carbon black does not provide sufficient conductivity to the monofilment, while concentrations of carbon black in excess of about 30 weight percent would result in unsatisfactory Tensile properties. The indicated concentrations of carbon black will result in a monofilament having a resistance of less than about 4 megaohms per cm.

The present monofilaments, after extrusion, are oriented by drawing about from 2.4 to 5.0 times their original length. The orientation is carried out by conventional techniques, typically by heating the filament above the glass transition temperature of the core polymer and stretching by passing through rolls of varying speeds. In general, orientation by heating in steam is preferred, since the resulting products generally exhibit a lower resistance with greater process yield.

The optimum draw ratio for any specific filament will, of course, vary. However, excessive orientation can increase the resistance to a level markedly greater than the specified 4 megaohms per cm. The resistance of the present filaments is measured with a Megger model 21158 hand-cranked insulation tester (James G. Biddle Co.) at 100° volts D.C. The alligator clamps are placed 2.54 cm apart on the sample to be tested.

The coextruded monofilaments of the present invention exhibit a Tensile Coefficient of about from 0.3 to 5.0. The Tensile Coefficient is a dimensionless number reflecting the stretch characteristics of the filaments, their stiffness and toughness in relation to the diameter of the monofiament. Toughness is approximated by the product of break load and elongation, and stiffness is measured by the initial modulus. It is, of course, necessary that these properties be in the same units. The Tensile Coefficient is calculated as the product of break load and elongation divided by the product of the initial modulus and the cube of the filament diameter. The Tensile Coefficient is calculated by the following formulas applicable to the various English or metric measurements systems $$= 21.4\sqrt{\text{density}} \times \frac{\text{Tenacity (grams/denier)} \times \text{Break Elongation (inches)}}{\text{Modulus (grams/denier)} \times \sqrt{\text{Denier}}}$$

$$= \frac{\text{Tensile Strength (megapascals)} \times \text{Break Elongation (mm)}}{\text{Modulus (megapascals)} \times \text{Diameter (mm)}}$$

$$= \frac{\text{Tensile Strength (lbs./in.}^2) \times \text{Break Elongation (inches)}}{\text{Modulus (lbs./in.}^2) \times \text{Diameter (inches)}}$$

$$\text{Tensile Coefficient} = \frac{\text{Break Load (lbs.)} \times \text{Break Elongation (inches)} \times \frac{4}{\pi}}{\text{Modulus (lbs/inch}^2) \times \text{Diameter}^3\text{ (inches)}}$$

The monofilaments of the present invention provide outstanding performance as hairbrush filaments. They exhibit the tensile properties necessary to provide the required balance of toughness, stiffness and bend recovery. In addition, without sacrifice of these tensile properties, the present monofilaments, through the use of a conductive sheath, provide an antistatic performance which permits use of the monofilaments as brush bristles without the static generation typical of hairbrushes. Moreover, this is accomplished without a conductive path through the handle of the brush as has been previously suggested in the art.

Coextruded monofilaments exhibiting a Tensile Coefficient outside of the specified range of about from 0.3 to 5.0 will be deficient in one or more of the above characteristics. For example, monofilaments having a Tensile Coefficient greater than about 5.0 will lack the stiffness required for brush bristles, while those having a Tensile Coefficient less than about 0.3 will not be tough enough for use as brush bristles.

The present sheath-core monofilaments, having carbon in the sheath component, have significantly greater toughness when compared, for example, to a monofilament having carbon black distributed throughout the filament. The present monofilaments also provide improved toughness over sheath-core monofilaments having a conductive core, since a conductive filler in the core, in order to provide electrical conductivity through the insulating sheath, would need to be present in large quantities that would depreciate the tensile properties. Moreover, the present filaments, through incorporation of the conductive filler throughout the conductive sheath, retain their electrical performance over periods of extended use, without any substantial quantity of the electrically conductive carbon breaking away onto the surface being brushed.

In the following examples, sheath core monofilaments were prepared by two basic techniques. In the first, the polymer and carbon black for the sheath component were separately melt blended prior to feeding to the coextrusion apparatus. These preblended sheath materials are referred to as "compounded". In a second technique, the sheath resin and carbon black are not melt blended prior to using the coextrusion apparatus, but are added as powder blends, and this technique is so identified.

EXAMPLES 1-5

In Examples 1 to 5, polyester resin was used for both the sheath and the core of the coextruded monofilaments. In each case, the sheath resin and carbon were melt blended prior to introduction into the coextrusion apparatus. In these Examples, polybutylene terephthalate was used for the core. The sheath polymers were copolyether esters prepared from dimethyl terephthalate, dimethylisophthalate, poly(tetramethylene oxide) glycol and excess 1,4-butanediol. The quantities of components, as combined with the copolyetherester, are as summarized in Table I. The balance of the copolyether esters consists of additives such as catalysts and antioxidants. In Example 5, the sheath was a 78/22 weight & blend and two polyether esters.

TABLE I

| Copolyether ester | Terephthaloyl Units | Isopthaloyl Units | Polytetramethylene ether glycol - Number Average Molecular Weight 1000 | Ethyl oxide-capped polypropylene ether glycol (Number Average Molecular Weight 2160) | Oxytetramethyleneoxy |
|---|---|---|---|---|---|
| A | 27.4% | 7.95% | 44.72 | — | 19.56 |
| B | 40.44 | — | 35.38 | — | 23.8 |
| C | 26.67 | 7.74 | — | 42.72 | 21.39 |
| D | 51.03 | — | 15.96 | — | 32.62 |

Batches of about 3000 grams were blended in an "OOC" Banbury mixer. The polyester resin and carbon were dried, weighed out separately, and stored in sealed containers until use. Half of the resin was added to the Banbury mixer, followed by the carbon black and finally the other half of the resin. The batch was mixed at 100 rpm while heating with steam to raise the temperature to the flux point. Then the speed of the mixer was reduced to keep the temperature of the resin and carbon below 204° C. Three minutes after reaching the flux temperature, the blended carbon and resin was removed from the mixer and cut while hot into a size suitable for granulating.

The carbon black used in these examples was either Vulcan P or Vulcan 9, both being electrically conductive carbon blacks commercially available from Cabot Corporation. The concentration of carbon black in the sheath polymer was 25% in all cases.

The sheath polymer, blended with carbon, was dried overnight in a vacuum oven at 95° to 120° C. prior to extrusion. The blended polymer was then introduced into a 28 millimeter twin screw extruder at a rate of 50-65 grams per minute at a temperature of 240° to 250° C. (about 30° C. above the melting point of the 4GT core polymer). The core polymer was introduced into an 83 millimeter twin screw extruder at a rate of 250-265 grams per minute after drying under nitrogen at 120°-150° C. for at least 16 hours.

The molten polymers from the two extruders were fed through an 8-hole coextrusion die with 2.54 mm capillaries. The coextruded monofilament was quenched in water.

The coextruded monofilaments were then oriented by drawing in line, heating with steam.

The polyester sheath/core materials were tested for tensile strength, break elongation, and modulus, and their diameters were measured. The Tensile Coefficient was calculated and is indicated in Table II, together with other properties of the resulting monofilaments.

TABLE II

| Example | Sheath Composition | Carbon Type | Draw Ratio | Resistance Caliper Megaohms/2.54 cm | Resistance Caliper mm | Break Stress Newtons | Break Strain % | Break Elong. for 2.54 cm Length (mm) | MPa Tens. Str. | Modulus MPa | Oval. mm | Tensile Coefficient |
|---|---|---|---|---|---|---|---|---|---|---|---|---|
| 1 | A | V9 | 3.5 | 0.2 | 0.465 ± 0.038 | 39 | 68 | 17.3 | 234 | 2380 | 0.053 | 3.7 |
| 2 | A | V9 | 3.5 | 0.2-2.0 | 0.516 ± 0.018 | 48 | 68 | 17.3 | 228 | 2130 | 0.051 | 3.6 |
| 3 | B | VP | 3.7 | 0.8-2.2 | 0.508 ± 0.033 | 40 | 47 | 11.9 | 193 | 2220 | 0.058 | 2.0 |
| 4 | C | V9 | 3.6 | 0.6-1.0 | 0.516 ± 0.091 | 48 | 55 | 14.0 | 234 | 2100 | 0.025 | 3.0 |
| 5 | A/D (78/22) | VP | 3.7 | 0.2-0.3 | 0.549 ± 0.030 | 54 | 74 | 18.8 | 228 | 2100 | 0.051 | 3.7 |

EXAMPLES 6-10 AND COMPARATIVE EXAMPLE A

In Examples 6 to 10 and Comparative Example A, sheath core monofilaments were prepared from polyamides used for both sheath and core. The sheath polymers were blended with carbon either by dry blending procedures or by a melt blending operation prior to introduction into the coextrusion apparatus.

In the dry, or powder blend procedure, a blend of nylon and carbon powder is tumble blended and dried over night at 120° C. in a vacuum oven. The nylon resin is cryogenically ground to pass 60 mesh and not pass 200 mesh. This powder was then blended with the indicated amount of carbon, tumbled, and dried overnight at 120° C. in a vacuum oven with a nitrogen bleed. The powder blend was then fed to a 28 mm twin-screw extruder while the indicated core polymer, after drying overnight in a hopper at 150° C. was being fed to an 83 mm twin-screw. Feed rate to the two screws was maintained at a 4/1 ratio with an overall rate of about 13.6 kg/hour. In all cases, the undrawn billets had a resistance of less than 20,000 ohms per cm. The eight filaments spun from a 2.54 mm capillary were water quenched and then drawn in atmospheric steam at 137 m per minute to get a filament of about 0.51 mm diameter. In general, resistance increased as the draw ratio increased. Carbons of very high effective volumes as determined by surface area and dibutylphthalate absorption (pore volume) lose their conductivity on drawing more so than the electrically conductive furnace blacks of lower effective volume.

In the melt blending procedure, nylon, cryogenically ground to pass a 60 mesh screen but be 90% retained by a 200 mesh screen is tumble blended with carbon black and dried in a vacuum oven. The powder blend is then fed to a 28 millimeter twin screw extruder operated at a speed of 100 rpm. The bushings included three kneading blocks to assure melting of the nylon and mixing of the carbon powder. After extrusion, the strands were cut into 3.2 mm lengths. The melt blended polymer and carbon black is designated as compounded.

The sheath polymer and carbon blends as well as the core polymer were supplied to extruders as in examples 1 to 5, and subsequently extruded through a coextrusion dye and oriented by stretching. The resulting monofilaments are tested and the results summarized in Table III.

TABLE III

| Example | Composition Sheath/Core | Carbon Powder Type | Carbon % in Blend | Carbon Addition Method | % Sheath | Draw Ratio | Resistance Megaohms/2.54 cm | Caliper mm | Break Strain % | Break Elong. for 2.54 cm length (mm) | MPa Tens. Str. | Modulus MPa | Oval mm | Tensile Coefficient |
|---|---|---|---|---|---|---|---|---|---|---|---|---|---|---|
| 6 | 612/612 | Vulcan P | 26 | Powder Blend | 20 | 2.6 | 0.05–0.6 | 0.475 | 61 | 15.5 | 158 | 2800 | 0.036 | 1.84 |
| 7 | 612/612 | Vulcan P | 26 | Compound | 20 | 2.6 | 1.5–7 | 0.417 | 29 | 7.4 | 131 | 2520 | 0.117 | 0.92 |
| 8 | 621/66 | Vulcan P | 26 | Compound | 13 | 2.4 | 0.05–0.15 | 0.498 | 60 | 15.2 | 138 | 2220 | 0.025 | 1.90 |
| 9 | 610/66 | Vulcan P | 26 | Powder Blend | 20 | 2.4 | 0.05–1 | 0.518 | 97 | 24.6 | 179 | 2400 | 0.051 | 3.54 |
| 10 | 612/612 | Vulcan P | 25 | Compound | 20 | 3.OS | 0.25 | 0.551 | 20 | 5.1 | 172 | 2480 | 0.135 | 0.64 |
| A | 6/66 | Vulcan P | 25 | Compound | 20 | 3.OR | 500 | 0.381 | 14 | 3.6 | 303 | 3720 | 0.061 | 0.77 |

I claim:

1. An oriented sheath-core monofilament suitable for use as a hairbrush bristle having a diameter of at least about 0.25 mm and (A) a core of polymer selected from the group consisting of nylon and polyester in which the polyester is at least about 60 weight percent polybutylene terephthalate and the balance of the polyester is selected from polyethylene terephthalate and cyclohexane dimethanol terephthalate, and (B) a sheath adhered to the core, comprising about 10–40 weight percent of the monofilament and prepared from polymers selected from the group consisting of nylon 11, nylon 12, nylon 610, nylon 612 and copolyetherester, the sheath polymer having a melting point no greater than that of the core, and the sheath containing about from 20 to 30 weight percent carbon black uniformly admixed with the sheath polymer, the monofilament having a resistance of less than about 4 megaohms per cm and a Tensile Coefficient of about from 0.3 to 5.0 and provided that when the core of the monofilament is polyester the sheath is copolyetherester, and that when the core is nylon, the sheath is nylon.

2. A monofilament of claim 1 wherein the carbon has a particle size of less than about 20 microns.

3. A monofilament of claim 1 wherein the melt viscosity of the sheath and core polymers is substantially the same.

4. A monofilament of claim 3 wherein the sheath and core polymers are polyester.

5. A monofilament of claim 4 wherein the core polymer consists essentially of polybutylene terephthalate.

6. A monofilament of claim 3 wherein the sheath and core polymers are polyamide.

* * * * *